US005700402A

United States Patent [19]

Jones et al.

[11] Patent Number: 5,700,402

[45] Date of Patent: Dec. 23, 1997

[54] CRANKCASE FUEL INJECTION SYSTEM FOR TWO-CYCLE INTERNAL COMBUSTION ENGINES

[76] Inventors: James S. Jones, 45 Crown Pl., Richardson, Tex. 75080; James M. Jones, 413 W. Jefferson, Waxahachie, Tex. 75165

[21] Appl. No.: 747,035

[22] Filed: Nov. 8, 1996

[51] Int. Cl.[6] ..... F02M 59/14

[52] U.S. Cl. ..... 261/35; 261/39.2; 123/73 C; 123/DIG. 5

[58] Field of Search ..... 261/35, 39.2; 123/73 C, 123/DIG. 5

[56] References Cited

U.S. PATENT DOCUMENTS

| | | | |
|---|---|---|---|
| 3,262,433 | 7/1966 | Jordan | 261/35 |
| 3,710,771 | 1/1973 | Cingnegrani | 261/39.2 |
| 4,700,668 | 10/1987 | Schierling et al. | 123/73 C |
| 4,807,573 | 2/1989 | Schierling et al. | 123/73 C |

*Primary Examiner*—Tim R. Miles
*Attorney, Agent, or Firm*—Jenkens & Gilchrist, P.C.

[57] ABSTRACT

A crankcase fuel injection system includes a diaphragm type fuel pump, a crankcase fuel injector assembly, and a main air inlet assembly. Engine crankcase pulses generated by the up and down movements of the piston are utilized by the fuel pump to replenish the fuel mixture in a fuel mixture injector chamber of the fuel injector assembly. The air mass entering the crankcase upon the upstroke of the piston is controlled within the main air inlet assembly by a throttle valve and metered across a main air venturi. The venturi signal at the main air venturi is amplified by a booster venturi. The amplified venturi signal is applied to a middle chamber formed between the two diaphragms of the compound diaphragm assembly which serves as the injector pump mechanism. The force acting upon the diaphragm assembly due to the amplified venturi signal is further amplified due to the area relationships of the two diaphragms. The resulting amplified force creates an inward movement of the compound diaphragm assembly which injects a fuel charge from the fuel chamber under pressure into the crankcase across a check valve and a fuel injector orifice. The air-fuel ratio is trimmed using an aneroid chamber or a trim adjustment screw to control the addition of bleed air into the amplified venturi signal.

24 Claims, 1 Drawing Sheet

CRANKCASE FUEL INJECTION SYSTEM FOR TWO-CYCLE INTERNAL COMBUSTION ENGINES

BACKGROUND

The present invention relates to fuel injection carburetor systems, and more particularly to mechanical fuel injection systems for use with two-cycle internal combustion engines.

The typical carburetor system utilized with the two-cycle internal combustion engine consists of a venturi type diaphragm carburetor which can be mounted to a port connected directly to the engine crankcase, or to a port located toward the lower end of the engine cylinder wall. The up and down movement of the engine's piston creates pressure pulses within the crankcase which are utilized to operate a diaphragm type fuel pump which feeds the mixture of gasoline and lubricating oil to the main fuel chamber of the carburetor across a needle valve. The air, fuel, and lubricating oil mixture is drawn into the crankcase from the carburetor during the upstroke of the engine's piston. A transfer passage feeds the mixture from the crankcase to the combustion chamber above the piston under the pressure generated in the crankcase by the downstroke of the piston. In order to assure a proper pressure to move the mixture from the crankcase into the combustion chamber, the outlet of the carburetor must be sealed during the downstroke of the piston. To seal the outlet of the carburetor during the downstroke of the piston, carburetors which mount directly to the crankcase utilize a reed valve or its equivalent, and carburetors which mount toward the lower end of the cylinder wall utilize the piston itself as a sealing device.

Recently, concerns have been raised regarding the pollution associated with power tools such as weed-eaters, mowers, leaf-blowers, chainsaws, and other devices utilizing two-cycle engines. There are several disadvantages associated with the carburetor system of a typical two-cycle engine. The design and operation of the typical two-cycle engine requires that a lubricating oil be mixed with the gasoline in order to provide the lubrication necessary for the engine's internal moving parts of the engine. The typical oil mixture ranges from approximately 2.5 to 6.0 percent. The excess oil within the system can result in an increase of pollutants, fouled spark plugs, inefficient operation, and increased fuel consumption. The fuel remaining within the fuel chamber of the diaphragm type carburetor is exposed to the atmosphere across the fuel orifice when the engine is at rest. The exposure of fuel to atmosphere results in the evaporation of raw fuel into the atmosphere which increases pollution.

It would be an advantage to have a carburetor system which could reduce or eliminate some of these problems that are associated with two-cycle engine systems. The present invention provides for a simple pressure injection system which can be used with a two-cycle engine. The present invention is particularly helpful in reducing the above problems by providing an injection system that assists in reducing the amount of lubricating oil necessary in the fuel-oil mixture and reducing the amount of fuel exposed to the atmosphere when the engine is at rest.

SUMMARY

In one embodiment, the present invention includes an injector system for use with an engine, the system comprising an air inlet body, an injector assembly body, a compound diaphragm, an injector fuel check valve, and a fuel pump. The air inlet body includes a main air inlet, a main air venturi in fluid communication with the main air inlet, a main outlet for allowing air passing through the main air inlet and the main air venturi to enter the engine, a booster venturi in fluid communication with the main air venturi, a booster venturi inlet for allowing the passage of air through the booster venturi into the main air venturi, and a venturi signal passage in fluid communication with the booster venturi. The injector assembly body includes an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine. The compound diaphragm has a first diaphragm separating the ambient air chamber from the venturi signal chamber, and a second diaphragm connected to the first diaphragm and separating the injector fuel chamber from the venturi signal chamber. The injector fuel check valve inhibits the flow of fluid out of the injector fuel chamber inlet. The fuel pump provides fluid to the injector fuel chamber inlet.

In another embodiment, the present invention includes a main air inlet body, means for controlling the flow of air, an injector assembly body, a compound diaphragm, an injector fuel check valve, and a fuel pump. The main air inlet body includes a main air inlet, a main air venturi in fluid communication with the main air inlet, a main air outlet for allowing air passing through the main air inlet and the main air venturi to enter the engine, a venturi signal passage in fluid communication with the main air venturi, and a bleed air inlet port for allowing air to pass therethrough into the venturi signal passage. The means for controlling the flow of air controls the flow of air through the bleed air inlet port to the venturi signal passage. The injector assembly body includes an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine. The compound diaphragm has a first diaphragm separating the ambient air chamber from the venturi signal chamber, and a second diaphragm connected to the first diaphragm and separating the fuel injector chamber from the venturi signal chamber. The injector fuel check valve inhibits the flow of fluid out of the injector fuel chamber inlet. The fuel pump provides fluid to the injector fluid chamber inlet.

In another embodiment, the present invention includes a main air inlet body, an injector assembly body, a compound diaphragm, an injector fuel check valve, and a fuel pump. The main air inlet body includes a main air inlet, a main air venturi in fluid communication with the main air inlet, a main air outlet for allowing air passing through the main air inlet and the main air venturi to enter the engine, and a venturi signal passage in fluid communication with the main air venturi. The injector assembly body includes an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine. The compound diaphragm has a first diaphragm separating the ambient chamber from the venturi signal chamber, and a second diaphragm connected to the first diaphragm and separating the injector fuel chamber from the venturi signal chamber. The injector fuel check valve inhibits the flow of fluid from out of the injector fuel chamber inlet. The fuel pump provides fluid to the injector fuel chamber inlet.

In a further aspect of the above embodiments, the present invention includes the area of the first diaphragm separating the ambient air chamber from the venturi signal chamber being a predetermined size greater than the area of the second diaphragm separating the venturi signal chamber from the injector fuel chamber.

In another aspect of the above embodiments, the system includes an injector outlet check valve to inhibit the exposure of fluid in the injector fuel chamber outlet when fluid is not being forced out of the injector fuel chamber by the first diaphragm.

In another aspect of the above embodiments of the present invention, the fuel pump comprises a fuel pump body, a pump diaphragm, and a fuel chamber check valve. The fuel pump body includes a fuel chamber having a fuel chamber inlet for receiving fluid and a fuel chamber outlet for supplying fluid to the injector fuel chamber inlet, and a pulse chamber for being in fluid communication with the crank case of the engine. The pump diaphragm separates the fuel chamber from the pulse chamber. The fuel check valve inhibits the flow of fluid out of the fuel chamber through the fuel chamber inlet.

In another aspect of the above embodiments of the present invention, the main air inlet body further includes a bleed air inlet port for allowing air to enter the venturi signal passage, and the present invention further includes means for controlling the flow of air from the bleed air inlet port to the venturi signal passage. In a further aspect, the means for controlling the passage of air comprises a metering pin connected to an aneroid chamber. In another further aspect, the means for controlling the passage of air through the bleed air inlet port into the venturi signal passage includes a tapered trim adjustment screw.

BRIEF DESCRIPTION OF THE DRAWINGS

These and other features, aspects, and advantages of the present invention will become better understood with regard to the following description, appended claims, and accompanying drawing where:

DETAILED DESCRIPTION

Figure 1:
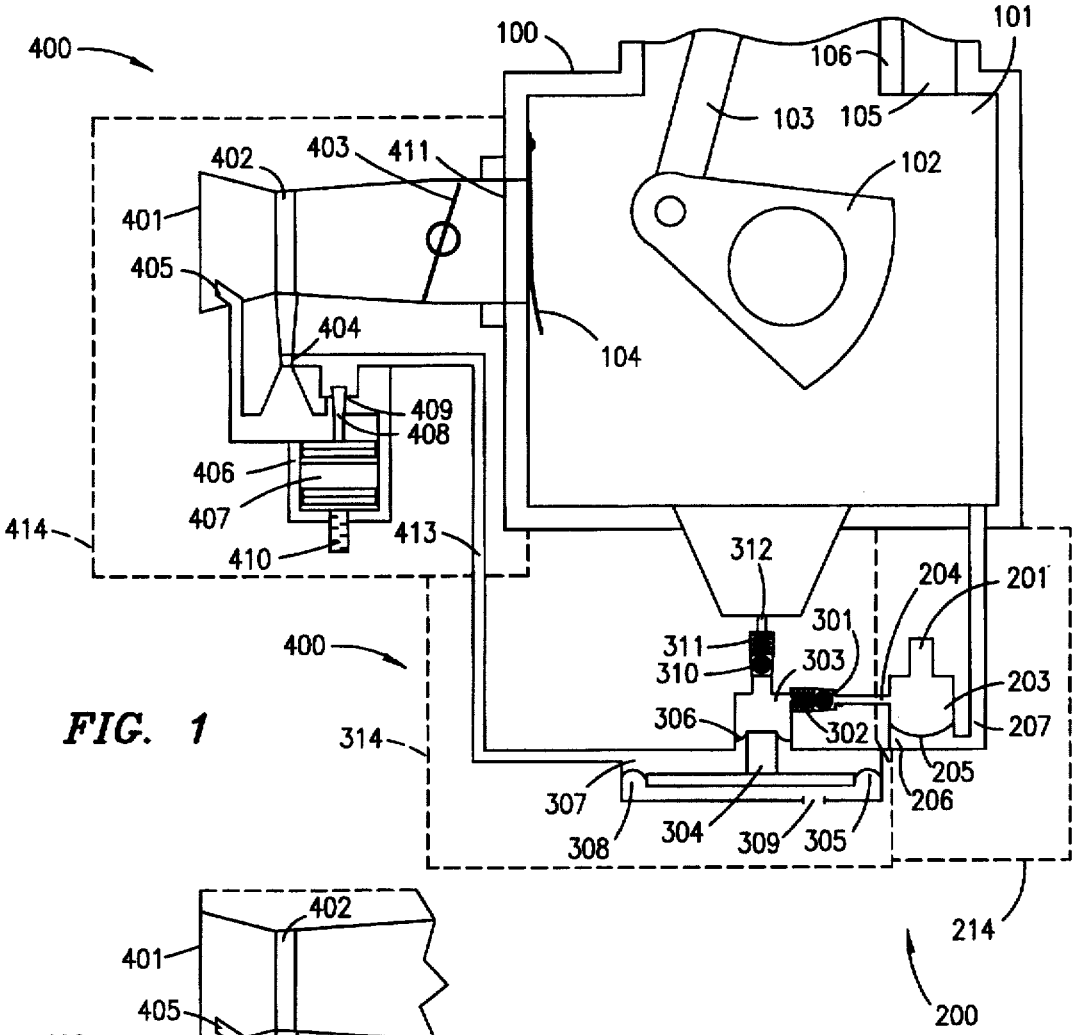
FIG. 1 is a schematic which partially illustrates a typical two-cycle engine crankcase with an embodiment of the present invention.

Referring now to the figures, and more particularly to FIG. 1, there is shown a two-cycle engine 100 utilizing one embodiment of the present invention. The two-cycle engine 100 is a typical two-cycle engine having a crankcase 101, a crankshaft 102, a connecting rod 103, a crankcase air inlet reed valve 104, a transfer passage 105, and a cylinder wall 106. In the embodiment illustrated in FIG. 1, the present invention includes a diaphragm type fuel pump 200, a fuel injector assembly 300, and a main air inlet assembly 400.

The diaphragm type fuel pump 200 includes a fuel chamber inlet 201, a fuel chamber check valve 202, a fuel chamber 203, a fuel chamber outlet 204, a pump diaphragm 205, and a pulse chamber 206. In one embodiment, fuel chamber inlet 201, a fuel chamber check valve 202, a fuel chamber 203, a fuel chamber outlet 204, a pump diaphragm 205, and a pulse chamber 206 are part of the fuel pump body 214. A person of ordinary skill in the art will understand that the fuel pump body 214 can be comprised of multiple sub-bodies. The pulse chamber 206 is in fluid communication with the crankcase 101 through a passageway 207. Pulses in the crankcase 101 create an up and down movement of the pump diaphragm 205. The up and down movement of the pump diaphragm 205 draws fuel-oil mixture from the fuel inlet 201 across the check valve 202 into the fuel chamber 203, and out of the fuel chamber 203 through the fuel outlet 204.

The fuel injector assembly 300 includes a normally closed check valve 301 with a closing spring 302, an injector fuel chamber 303, an venturi signal chamber 307, an ambient air chamber 308, a compound diaphragm assembly 304 having a smaller diaphragm 306 and a larger diaphragm 305, an injector outlet check valve 310 with a closing spring 311, and an injector orifice 312. In one embodiment, the injector fuel chamber 303, the venturi signal chamber 307, the ambient air chamber 308, and the injector orifice 312 are part of an injector assembly body 314. A person of ordinary skill in the art will understand that the injector assembly body 314 can be comprised of multiple sub-bodies. The smaller diaphragm 306 of the compound diaphragm assembly 304 separates the injector fuel chamber 303 from the amplified venturi signal chamber 307. The larger diaphragm 305 of the compound diaphragm assembly 304 separates the amplified venturi signal chamber 307 from the ambient air chamber 308. The inward side of the smaller diaphragm 306 forms one wall of the fuel injector chamber 303. The outward side of the smaller diaphragm 306 and the inward side of the larger diaphragm 305 each form a wall of the amplified venturi signal chamber 307. The outward side of the larger diaphragm 305 forms one wall of the ambient air chamber 308. The ambient air chamber 308 is exposed to atmospheric air pressure across a vent hole 309.

The injector fuel chamber 303 receives the fuel-oil mixture from the fuel outlet 204 across the normally closed check valve 301 and the closing spring 302. The fuel-oil mixture exits the fuel injector chamber 303 across the injector outlet check valve 310 and the closing spring 311, and through the injector orifice 312 into the crankcase 101.

The main air inlet assembly 400 includes a main air inlet 401, a main air venturi 402, a throttle valve 403, a main air outlet 411, a booster venturi 404, a booster venturi inlet/bleed air inlet air passage 405, a venturi signal passage 413, a bleed air inlet port 409, a metering pin 408, and an aneroid chamber 406. In one embodiment, the main air inlet 401, the main air venturi 402, the main air outlet 411, the booster venturi 404, the air passage 405, the bleed air inlet port 409, and the venturi signal passage 413 are part of a main air inlet body 414. A person of ordinary skill will understand that the main air inlet body 414 can be comprised of multiple sub-bodies. Air enters the air inlet 401 in the main air inlet body 400, passes through the main air venturi 402 and across the throttle valve 403 before exiting the main air outlet 411 into the crankcase 101 via the crankcase air inlet valve 104. The throttle valve 403 controls the rate that the air flows into the crankcase 101 from the air inlet 401 and the main air venturi 402. The booster venturi 404 is in fluid communication with the main air venturi 402 and is fed by an air passage 405. In one embodiment, the inlet of the booster venturi inlet passage 405 is located within the air inlet 401 and facing the same direction. The booster venturi 404 is in fluid communication with the amplified venturi signal chamber 307.

The aneroid sensor 406 is provided in order to compensate for changes in the air density which cause the air-fuel ratio to drift. The bleed air inlet port 409 connects the booster venturi inlet 405 feeding the booster venturi 404 with the passageway 413 connecting the booster venturi 404 to the amplified venturi signal chamber 307. The metering pin 408 is disposed within the fixed bleed port 409 and is connected to the aneroid sensor 406. The aneroid sensor 406 contains an inert gas within a chamber 407 which expands or contracts due to changes in the air density, thereby expanding and contracting the aneroid sensor 406. The expansion and contraction of the aneroid sensor 406 increases and decreases the open area formed between the metering pin 408 and the fixed bleed port 409. An initial trim adjustment for the aneroid sensor 406 is provided by a positioning screw 410 which can be made to be tamper proof after the initial test run.

When the engine is at rest, the crankcase reed valve 104, check valve 301, and the injector outlet check valve 310 are closed. The normally closed fuel outlet ball check valve 310 assures that no fuel in the fuel chamber 303 is exposed to the atmosphere when the engine is at rest.

Upon operation of the engine 100, the upward stroke of the engine piston (not shown) generates a partial vacuum within the crankcase 101 which causes a downward movement of the fuel pump diaphragm 205. The downward movement of the fuel pump diaphragm 205 draws fuel across the check valve 202 into the fuel chamber 203. The crankcase reed valve 104 also opens on this upward stroke of the piston also causes air movement across the air inlet 401, the main air venturi 402, the throttle valve 403, and the main air outlet 411 of the main air inlet assembly 400 and into the crankcase 101.

A vacuum signal is generated by the air movement across the main air venturi 402 which is amplified by the booster venturi 404. The amplified vacuum signal from the booster venturi 404 acts upon the amplified venturi signal chamber 307. The amplified vacuum signal in the amplified venturi signal chamber 307 creates a force against the compound diaphragm 304 in the direction of the injector fuel chamber 303. The force against the compound diaphragm 304 created by the amplified vacuum signal is also amplified by the ratio of the area of the larger diaphragm 305 to the smaller diaphragm 306. The force exerted by the amplified vacuum signal against the compound diaphragm 304 causes a movement of the compound diaphragm assembly 304 towards the injector fuel chamber 303. As the compound diaphragm 304 moves toward the injector fuel chamber 303, the smaller diaphragm 306 forces the fuel-oil mixture within the injector fuel chamber 303 to unseat the check valve 310 by overcoming the force of the closing spring 311 upon the check valve 310 which allows the fuel-oil mixture under pressure to be injected across the injector orifice 312 into the crankcase 101. The force which moves the fuel-oil mixture into the crankcase 101 is therefore proportional to the air mass moving into the system across the main air venturi 402. An increase in the air flow through the system results in an increase in the fuel-oil mixture flow across the fuel injector orifice 312, and a decrease in the air flow results in a decrease in the flow of the fuel-oil mixture.

As shown, the compound diaphragm 304 exerts an amplified force upon the fuel-oil mixture in the fuel injector chamber 303 that is generated by the air movement through the main air venturi 402 during operation. In one embodiment, the booster venturi 404 amplifies the signal from the main venturi 402 by a ratio of approximately 3 to 1, and the area ratio of the larger diaphragm 305 of the compound diaphragm assembly 304 to the smaller diaphragm 306 is approximately 25 to 1. This arrangement amplifies the force exerted by the small diaphragm 306 upon the fuel-oil mixture in the fuel injector chamber 303 a factor of 75 (3×25). For example, a signal of four inches of water in the main air venturi 402 results in a force that will create a pressure of 300 inches of water, or 10.83 psig, upon the fuel-oil mixture in the injector fuel chamber 303 that is injected into the crankcase 101. Under these conditions, the lubricating oil of the fuel-oil mixture injected into the crankcase 101 would tend to remain on the internal surfaces inside the engine 100, where it is required. The gasoline of the fuel-oil mixture, with its lower dew point, would absorb latent heat from the hotter surfaces within the crankcase, and would leave these surfaces at a very high molecular velocity entering the transfer passage 105 to the combustion chamber as a well blended air-fuel charge with only slight traces of lubricating oil molecules. Therefore, the amount of oil in the fuel-oil mixture can be reduced which would reduce pollution, plug fouling, and fuel consumption, while increasing the top end torque.

The aneroid sensor 406 is utilized to automatically sense the changes in the air density and to trim the air-fuel blend in response thereto. As the air density increases, the volume of inert gas within the chamber 407 contracts, thereby contracting the aneroid sensor 406. A decrease in the air density results in an expansion of the inert gas within the chamber 407 of the aneroid sensor 406, thereby expanding the aneroid sensor 406. These expanding or contracting movements of the aneroid sensor 406 increase or decrease the open area between the bleed air inlet port 409 and the metering pin 408 which is attached to the aneroid sensor 406. In this manner the proper air-fuel ratio is maintained by automatically manipulating the amplified venturi signal acting upon the compound diaphragm assembly 304 using bleed air from passageway 405, which varies the pressure acting upon the fuel injector chamber 303.

As the engine piston begins the downstroke, the pressure in the crankcase 101 begins to increase. When the pressure in the crankcase 101 exceeds the pressure at the main air outlet 411, the crankcase reed valve 114 closes which stops the air flow through the main air inlet assembly 400 into the crankcase 101. The increase in pressure within the crankcase 101 also creates an upward movement of the fuel pump diaphragm 205. The upward movement of the fuel pump diaphragm 205 forces the fuel-oil mixture across the check valve 301 which replenishes the injector fuel chamber 303. The injector outlet check valve 310 and the closing spring 311 restrict movement of the fuel-oil mixture across the injector orifice 312 between the injections of the fuel-oil mixture into the crankcase 101 by the compound diaphragm assembly 304. During the downstroke of the engine piston, the air and the fuel, which were introduced into the crankcase 101 during the initial upstroke of the engine piston, enter the transfer passage 105 which feeds the engine's combustion chamber (not shown). The cycle begins anew on the following upstroke.

Figure 2:
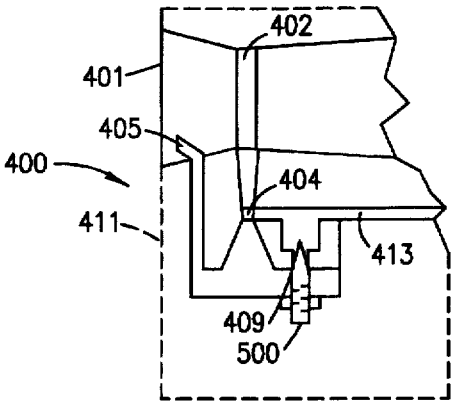
FIG. 2 is a schematic which partially illustrates another embodiment of a trim control of the present invention.

Referring now to FIG. 2, there is shown another embodiment of the present invention in which a tapered trim adjustment screw 500 replaces the aneroid sensor 406 and the metering pin 408 shown in FIG. 1. The tapered trim adjustment screw 500 provides a manual means to trim the controlled air bleed placed upon the amplified venturi signal chamber 307, in order to maintain the proper fuel-oil mixture flow. The opening between the fixed bleed port 409 and the trim adjustment screw 500 controls the amount of bleed air that passes from the passageway 405 to the amplified venturi signal chamber 307 through the passageway 413. Therefore, the amplified venturi signal acting upon the amplified venturi signal chamber 307 can be manipulated by changing setting of the trim adjustment screw 500 in order to maintain the proper air-fuel blend.

It is thus believed that the operation and construction of the present invention will be apparent from the foregoing description. While the method and apparatus shown and described has been characterized as being preferred, it will be readily apparent that various changes and modifications could be made therein without departing from the spirit and scope of the invention as defined in the following claims.

What is claimed is:

1. An injector system for use with an engine, said system comprising:

an air inlet body including:

a main air inlet, a main air venturi in fluid communication with the main air inlet, a main air outlet for allowing air passing through the main air inlet and the main air venturi to enter the crankcase of the engine, a booster venturi in fluid communication with the main air venturi, a booster venturi inlet for allowing the passage of air through the booster venturi to the main air venturi, and a venturi signal passage in fluid communication with the booster venturi;

an injector assembly body including:

an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine;

a compound diaphragm having a first diaphragm separating the ambient air chamber from the venturi signal chamber, and a second diaphragm connected to the first diaphragm and separating the injector fuel chamber from the venturi signal chamber;

an injector fuel check valve for inhibiting the flow of fluid out of the injector fuel chamber inlet; and a fuel pump for providing fluid to injector fuel chamber inlet.

2. The system according to claim 1, wherein the area of the first diaphragm separating the ambient air chamber from the venturi signal chamber is a predetermined size greater than the area of the second diaphragm separating the venturi signal chamber from the injector fuel chamber.

3. The system according to claim 1, further including an injector outlet check valve to inhibit the exposure of fluid in the injector fuel chamber outlet when fluid is not being forced out of the injector fuel chamber by the first diaphragm.

4. The system according to claim 1, wherein the air inlet body further includes a bleed air inlet port for allowing air to pass therethrough into the venturi signal passage, and further including means for controlling the flow of air through the bleed air inlet port into the venturi signal passage.

5. The system according to claim 4, wherein said means for controlling the passage of air through the bleed air inlet port into the venturi signal passage comprises a metering pin connected to an aneroid chamber, wherein expansion of said aneroid chamber moves the metering pin to permit a greater flow of air through the bleed air inlet port into the booster venturi passage and contraction of said aneroid chamber moves the metering pin to permit a lesser flow of air through the bleed air inlet port into the booster venturi passage.

6. The system according to claim 5, wherein said aneroid chamber includes a positioning screw for initial trim adjustment.

7. The system according to claim 4, wherein said means for controlling the passage of air through the bleed air inlet port into the venturi signal passage comprises a tapered trim adjustment screw.

8. The system according to claim 4, further including an injector outlet check valve to inhibit the exposure of fluid in the injector fuel chamber outlet when fluid is not being forced out of the injector fuel chamber by the first diaphragm.

9. The system according to claim 4, wherein the bleed air inlet port receives the air that passes through the bleed air inlet port into said venturi signal passage from the booster venturi inlet.

10. The system according to claim 9, wherein said means for controlling the passage of air through the bleed air inlet port into the venturi signal passage comprises a metering pin connected to an aneroid chamber, wherein expansion of said aneroid chamber moves the metering pin to permit a greater flow of air through the bleed air inlet port into the booster venturi passage and contraction of said aneroid chamber moves the metering pin to permit a lesser flow of air through the bleed air inlet port into the booster venturi passage.

11. The system according to claim 10, wherein said aneroid chamber includes a positioning screw for initial trim adjustment.

12. The system according to claim 9, wherein said means for controlling the passage of air through the bleed air inlet port into the booster signal passage comprises a tapered trim adjustment screw.

13. The system according to claim 9, further including an injector outlet check valve to inhibit the exposure of fluid in the injector fuel chamber outlet when fluid is not being forced out of the injector fuel chamber by the first diaphragm.

14. The system according to claim 1, wherein said fuel pump comprises:

a fuel pump body including:

a fuel chamber having a fuel chamber inlet for receiving fluid and a fuel chamber outlet for supplying fluid to the injector fuel chamber inlet, and a pulse chamber for being in fluid communication with a crankcase of the engine;

a pump diaphragm separating the fuel chamber from the pulse chamber; and a fuel chamber check valve for inhibiting flow of fluid out of the fuel chamber through the fuel chamber inlet.

15. An injector system for use with an engine, said system comprising:

an air inlet body including:

a main air inlet, a main air venturi in fluid communication with the main air inlet, a main air outlet for allowing air passing through the main air inlet and the main air venturi to enter the crankcase of the engine, a venturi signal passage in fluid communication with the main air venturi, and a bleed air inlet port for allowing air to pass therethrough and into the venturi signal passage;

means for controlling the flow of air through the bleed air inlet port into the venturi signal passage;

an injector assembly body including:

an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine;

a compound diaphragm having a first diaphragm separating the ambient air chamber from the venturi signal chamber, and a second diaphragm connected to the first diaphragm and separating the injector fuel chamber from the venturi signal chamber;

an injector fuel check valve for inhibiting the flow of fluid out of the injector fuel chamber inlet; and a fuel pump for providing fluid to injector fuel chamber inlet.

16. The system according to claim 15, wherein the area of the first diaphragm separating the ambient air chamber from the venturi signal chamber is a predetermined size greater than the area of the second diaphragm separating the venturi signal chamber from the injector fuel chamber.

17. The system according to claim 15, further including an injector outlet check valve to inhibit the exposure of fluid in the injector fuel chamber outlet when fluid is not being forced out of the injector fuel chamber by the first diaphragm.

18. The system according to claim 15, wherein said means for controlling the passage of air through the bleed air inlet port into the venturi signal passage comprises a metering pin connected to an aneroid chamber, wherein expansion of said aneroid chamber moves the metering pin to permit a greater flow of air through the bleed air inlet port into the booster venturi passage and contraction of said aneroid chamber moves the metering pin to permit a lesser flow of air through the bleed air inlet port into the booster venturi passage.

19. The system according to claim 18, wherein said aneroid chamber includes a positioning screw for initial trim adjustment.

20. The system according to claim 15, wherein said means for controlling the passage of air through the bleed air inlet port into the venturi signal passage comprises a tapered trim adjustment screw.

21. An injector system for use with an engine, said system comprising:

an air inlet body including:

a main air inlet, a main air venturi in fluid communication with the main air inlet, a main air outlet for allowing air passing through the main air inlet and the main air venturi to enter the crankcase of the engine, and a venturi signal passage in fluid communication with the main air venturi;

an injector assembly body including:

an ambient air chamber, a venturi signal chamber in fluid communication with the venturi signal passage, and an injector fuel chamber having an injector fuel chamber inlet and an injector fuel chamber outlet for allowing the passage of fluid from the injector fuel chamber into the engine, and a compound diaphragm having a first diaphragm separating the ambient air chamber from the venturi signal chamber and a second diaphragm connected to the first diaphragm and separating the injector fuel chamber from the venturi signal chamber;

an injector fuel check valve for inhibiting the flow of fluid from out of the injector fuel chamber inlet; and a fuel pump for providing fluid to injector fuel chamber inlet.

22. The system according to claim 21, wherein the area of the first diaphragm separating the ambient air chamber from the venturi signal chamber is a predetermined size greater than the area of the second diaphragm separating the venturi signal chamber from the injector fuel chamber.

23. The system according to claim 21, further including an injector outlet check valve to inhibit the exposure of fluid in the injector fuel chamber outlet when fluid is not being forced out of the injector fuel chamber by the first diaphragm.

24. The system according to claim 21, wherein said fuel pump comprises:

a fuel pump body including:

a fuel chamber having a fuel chamber inlet for receiving fluid and a fuel chamber outlet for supplying fluid to the injector fuel chamber inlet, and a pulse chamber for being in fluid communication with a crankcase of the engine;

a pump diaphragm separating the fuel chamber from the pulse chamber; and a fuel chamber check valve for inhibiting flow of fluid out of the fuel chamber through the fuel chamber inlet.

* * * * *